US010377535B2

(12) United States Patent
Sommer

(10) Patent No.: US 10,377,535 B2
(45) Date of Patent: Aug. 13, 2019

(54) HINGE SEGMENT WITH INTEGRATED SECURITY TAB

(71) Applicant: Monoflo International, Inc., Winchester, VA (US)

(72) Inventor: Axel Sommer, Tacoma, WA (US)

(73) Assignee: MONOFLO INTERNATIONAL, INC., Winchester, VA (US)

( * ) Notice: Subject to any disclaimer, the term of this patent is extended or adjusted under 35 U.S.C. 154(b) by 695 days.

(21) Appl. No.: 14/553,064

(22) Filed: Nov. 25, 2014

(65) Prior Publication Data

US 2015/0284152 A1 Oct. 8, 2015

Related U.S. Application Data

(60) Provisional application No. 61/975,552, filed on Apr. 4, 2014.

(51) Int. Cl.
*B65D 43/00* (2006.01)
*B65D 43/16* (2006.01)
*B65D 21/02* (2006.01)

(52) U.S. Cl.
CPC ..... *B65D 43/164* (2013.01); *B65D 21/0233* (2013.01)

(58) Field of Classification Search
CPC ..... B65D 43/164; B65D 43/165; B65D 21/0233; B29L 2031/22
USPC ..... 220/810
See application file for complete search history.

(56) References Cited

U.S. PATENT DOCUMENTS 3,295,714 A * 1/1967 Di Addario ..... E05D 7/1077 16/257
3,463,345 A * 8/1969 Bockenstette ..... B65D 21/064 206/508
3,655,088 A * 4/1972 Box ..... B65D 43/164 206/427
4,564,974 A 1/1986 McGrail et al.
4,663,803 A 5/1987 Gora
5,392,938 A 2/1995 Dubach
5,474,200 A 12/1995 Nicholson
5,490,306 A 2/1996 Floyd et al.
5,553,351 A 9/1996 Starks
5,555,996 A * 9/1996 Lang-Ree ..... B65D 43/164 206/505
5,706,555 A * 1/1998 Furtner ..... B65D 11/1833 16/257
5,718,350 A * 2/1998 Williams ..... B65D 21/0219 220/326
6,000,576 A * 12/1999 Liu ..... B65D 21/064 206/508
6,047,853 A * 4/2000 Frankenberg ..... B65D 1/22 16/262
6,318,586 B1 * 11/2001 Frankenberg ..... B65D 21/0219 206/508

(Continued)

*Primary Examiner* — Ernesto A Grano
(74) *Attorney, Agent, or Firm* — Nixn & Vanderhye P.C.

(57) ABSTRACT

A hinge segment is coupleable with a container lid for connecting the container lid to a container. The container has hinge segment openings with a shoulder defining an undercut. The hinge segment includes hinge pins pivotably securable in the hinge segment openings and a security tab engageable with the undercut. The design is particularly suited for containers with all plastic hinges and provides a high level of security and tamper evidence.

10 Claims, 6 Drawing Sheets

(56) References Cited

U.S. PATENT DOCUMENTS 6,810,562 B1 * 11/2004 Horne ..... E05D 7/1044 16/254
7,090,095 B2 * 8/2006 Schafer ..... B65D 43/166 16/262
7,380,310 B2 * 6/2008 Koessler ..... E05D 7/1077 16/266
7,841,487 B2 * 11/2010 Miller ..... B29C 45/006 220/826
8,066,143 B2 * 11/2011 Baltz ..... B65D 1/22 220/324
8,261,410 B2 * 9/2012 Sze ..... B29C 49/48 16/262
8,286,828 B2 * 10/2012 Schafer ..... B65D 11/18 220/324
2004/0000030 A1 * 1/2004 Pleiman ..... A45C 13/005 16/267
2004/0144793 A1 * 7/2004 Lessard ..... B65D 43/164 220/836
2004/0182872 A1 * 9/2004 Lessard ..... B65D 43/164 220/826
2006/0091145 A1 * 5/2006 Miller ..... B29C 45/006 220/826
2006/0186123 A1 * 8/2006 Baltz ..... B65D 1/22 220/324
2006/0288532 A1 * 12/2006 Kim ..... E05D 7/1077 16/267
2011/0303691 A1 * 12/2011 Frankenberg ..... B65D 1/22 220/780
2012/0255965 A1 * 10/2012 King ..... B65D 43/164 220/826
2012/0279980 A1 * 11/2012 Koefelda ..... B65D 43/164 220/826
2014/0069949 A1 * 3/2014 Niemann ..... B65D 43/14 220/840

* cited by examiner

HINGE SEGMENT WITH INTEGRATED SECURITY TAB

CROSS-REFERENCES TO RELATED APPLICATIONS

This application claims the benefit of U.S. Provisional Patent Application Ser. No. 61/975,552, filed Apr. 4, 2014, the entire content of which is herein incorporated by reference.

STATEMENT REGARDING FEDERALLY SPONSORED RESEARCH OR DEVELOPMENT (Not Applicable)

BACKGROUND OF THE INVENTION

The invention relates generally to containers and, more particularly, to a hinge segment coupleable with a lid for connecting a container lid to a container. The hinge segment includes a security tab cooperable with a shoulder on the container.

Molded plastic containers are available in many different shapes and sizes. The containers are rugged and sturdy while being inexpensive to manufacture. When not in use, such containers are typically constructed such that they are stackable for compact transport.

A container lid is typically separately molded and cooperable with the container to close the container. In one construction, the container lid is pivotally secured to the container using hinge pins or the like. The hinge pins may be integrally molded with the container lid and cooperable with corresponding slots formed in a top perimeter of the container.

The security of such containers can be problematic as the integral hinge pins may be secured in the container slots in a snap fit, which can be subject to unauthorized access. Still further, with a simple snap-in hinge, it may not be readily apparent that the container had been subjected to an unauthorized breach.

BRIEF SUMMARY OF THE INVENTION

It would thus be desirable to improve security for plastic containers and to provide tamper evidence in the event that an attempt was made to breach the contents of a container. It is desirable to provide such enhanced security in a molded container with an all-plastic hinge. That is, it would be desirable to improve security for a plastic molded container and lid where a hinge assembly is integrated with the lid and/or container.

A plurality of hinge segments may be connected to the container lid. The hinge segments include a security tab positionable in an undercut in the container defined by a shoulder. The lid may have multiple hinge segments that engage the container with hinge pins. The design provides a high level of security and tamper evidence.

In an exemplary embodiment, a container includes an enclosure including a top perimeter and a container lid. The top perimeter of the enclosure has hinge segment openings with a shoulder defining an undercut. A plurality of hinge segments connected to the container lid include hinge pins pivotably secured in the hinge segment openings and a security tab engageable with the undercut. The hinge pins may be secured in slots defined in sides of the hinge segment openings. The hinge segments may be substantially T-shaped in a front view including a main panel and the hinge pins, and the hinge segments may be substantially L-shaped in a side view including the main panel and the security tab.

The enclosure may include two sides and two ends, where the sides are longer than the ends, and where the hinge segment openings are defined in the sides. In this context, the hinge segments may include segment rails connected to the container lid adjacent sides of the hinge segment openings and extending substantially parallel to the container ends. The security tab may be disposed spaced from the segment rails. The security tab may be positioned on an opposite side of the hinge segment from the container lid.

The hinge segments may be displaceable between an open position and a closed position, and in the closed position, the security tab is engaged with the undercut and the shoulder is disposed between the security tab and the hinge pins.

The container lid may be secured to the enclosure with parts made only of plastic.

In another exemplary embodiment, a hinge segment is coupleable with a container lid for connecting the container lid to a container. The hinge segment includes hinge pins pivotably securable in the hinge segment openings and a security tab engageable with the undercut. The hinge segment may also include a main panel oriented in a plane substantially perpendicular with the container lid, and segment rails on disposed opposite sides of the main panel. The hinge pins may be coupled with the segment rails and extend outward from the segment rails. The security tab may be substantially perpendicular to the main panel and spaced from the segment rails along the main panel, where the space between the security tab and the segment rails is sized to receive the shoulder.

In yet another exemplary embodiment, a container includes an enclosure including a top perimeter and a container lid. The top perimeter has hinge segment openings with a shoulder defining an undercut. A plurality of hinge segments connected to the container lid include hinge pins pivotably secured in the hinge segment openings and a security tab engageable with the undercut. The hinge segments may be displaceable between an open position and a closed position, and in the closed position, the security tab and the hinge pins are disposed on opposite sides of the shoulder.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
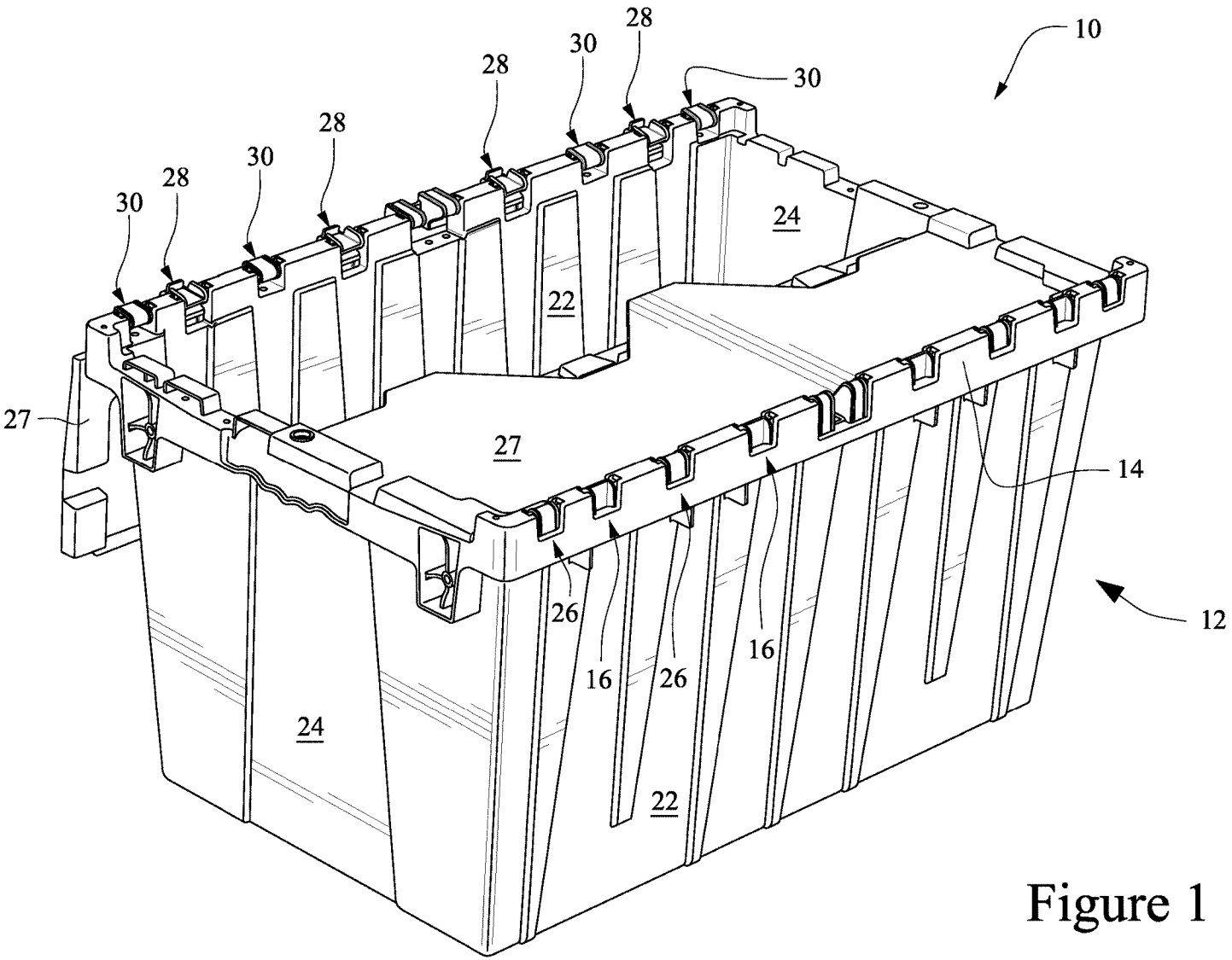
FIG. 1 is a perspective view of a container and lid assembly including hinge segments of preferred embodiments.

FIG. 1 is a perspective view of an exemplary container incorporating the hinge segments of described embodiments. The container 10 includes an enclosure 12 with a top perimeter 14. The top perimeter 14 is provided with a plurality of hinge segment openings 16 including a shoulder 18 defining an undercut 20. The enclosure 12 includes two sides 22 and two ends 24 as shown. The sides 22 are generally longer than the ends 24. The hinge segment openings 16 may be formed in the top perimeter 14 of the sides 22.

In an exemplary construction, the hinge segment openings 16 in the top perimeter 14 are interposed between typical hinge openings 26. The typical hinge openings 26 do not include the shoulder 18 or undercut 20. In alternative constructions, the container may include only hinge segment openings 16. Four hinge segments openings 16 are shown on each side 22 in FIG. 1, and more or fewer hinge segment openings 16 may be included. It is preferable to include at least one hinge segment opening 16 on opposite sides of a center line through the sides 22 of the enclosure 12.

A container lid 27 is pivotably securable to the enclosure 12 by suitable hinges. In the exemplary embodiment shown in FIG. 1, the container lid 27 includes separated lid panels that are securable in an overlapping connection as is conventional. The lid panels may be secured with a cable tie or the like in an aperture through the overlapping centers of the lid panels and into a corresponding aperture in the perimeter 14 of the enclosure 12.

A plurality of hinge segments 28 are connected to the container lid 27. Preferably, the hinge segments 28 are integrally molded with the container lid 27. The lid may also include hinge pieces 30 without the security features of the described embodiments. Both the hinge segments 28 and the hinge pieces 30 include hinge pins 32 pivotably secured in hinge pin slots 33 of the respective openings 16, 26 in the top perimeter 14 of the enclosure 12. See FIG. 6. In an exemplary construction, the hinge pins 32 are received in the hinge pin slots 33 in a snap fit or may alternatively be held in the hinge pin slots 33 with a cover or overlay or covered portion of the enclosure 12.

Figure 2:
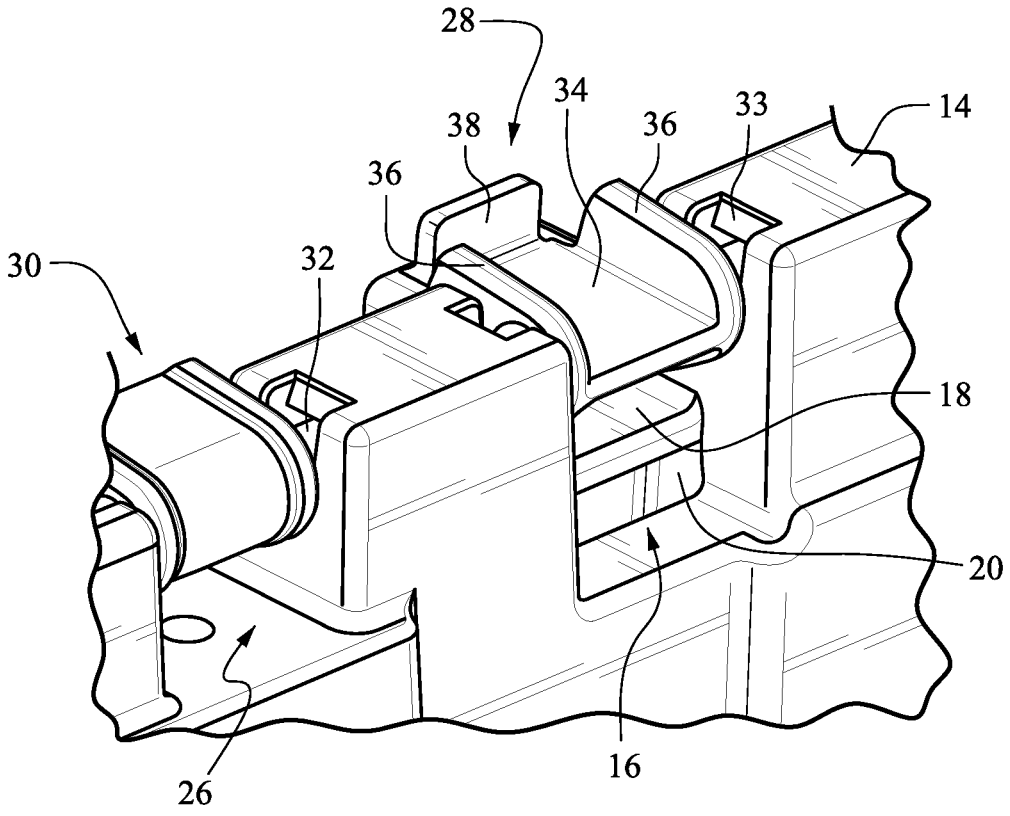
FIG. 2 is a close-up view of the hinge segments.
Figure 6:
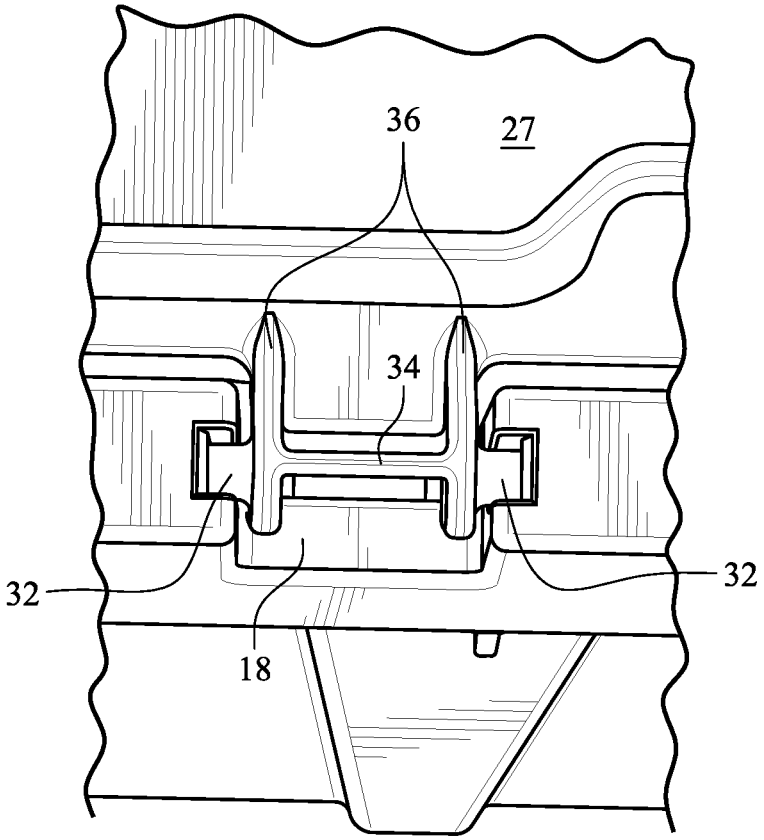
FIG. 6 is a plan view of a hinge segment with the container lid in a closed position.

With reference to FIGS. 2 and 6, the hinge segments 28 include a main panel 34 oriented in a plane substantially perpendicular with the container lid 27 and segment rails 36 disposed on opposite sides of the main panel 34 as shown. The hinge segments 28 also include a security tab 38 that is substantially perpendicular to the main panel 34 and is spaced a distance A (FIG. 4) from the segment rails 36 along the main panel 34 by an amount generally corresponding to a thickness of the shoulder 18. The security tab 38 is positioned on an opposite side of the hinge segment 28 from the container lid 27. As shown in the drawings, the hinge pins 32 are coupled, preferably integral, with the segment rails 36 and extend outward from the segment rails 36.

The hinge segments 28 are substantially T-shaped in a front view as defined by the main panel 34 and the hinge pins 32. In side view, the hinge segments 28 are substantially L-shaped including the main panel 34 and the security tab 38.

Figure 3:
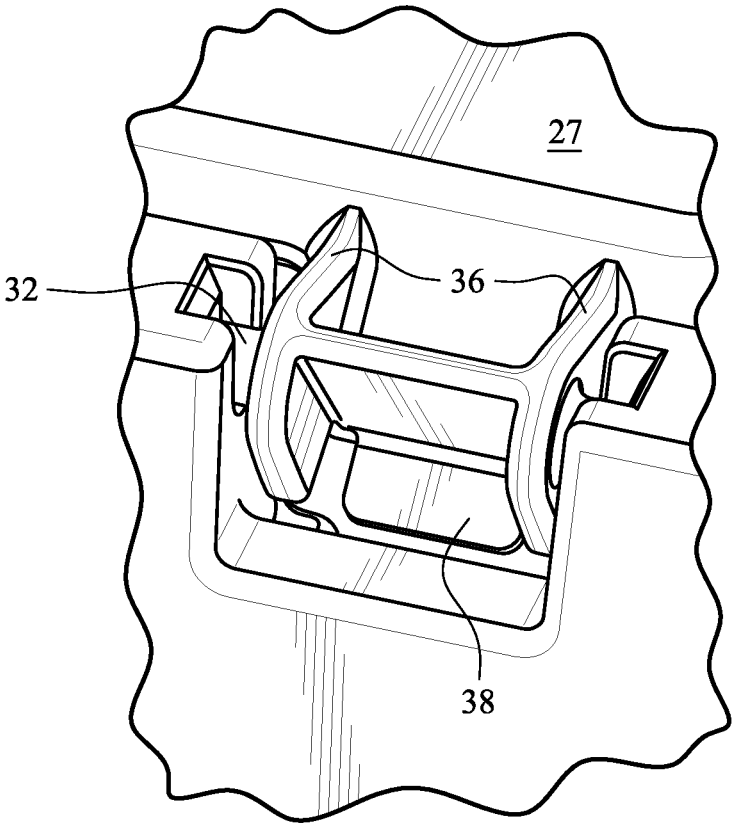
FIGS. 3-5 show a closing sequence for the container lid and the interaction of the hinge segments with the container.
Figure 4:
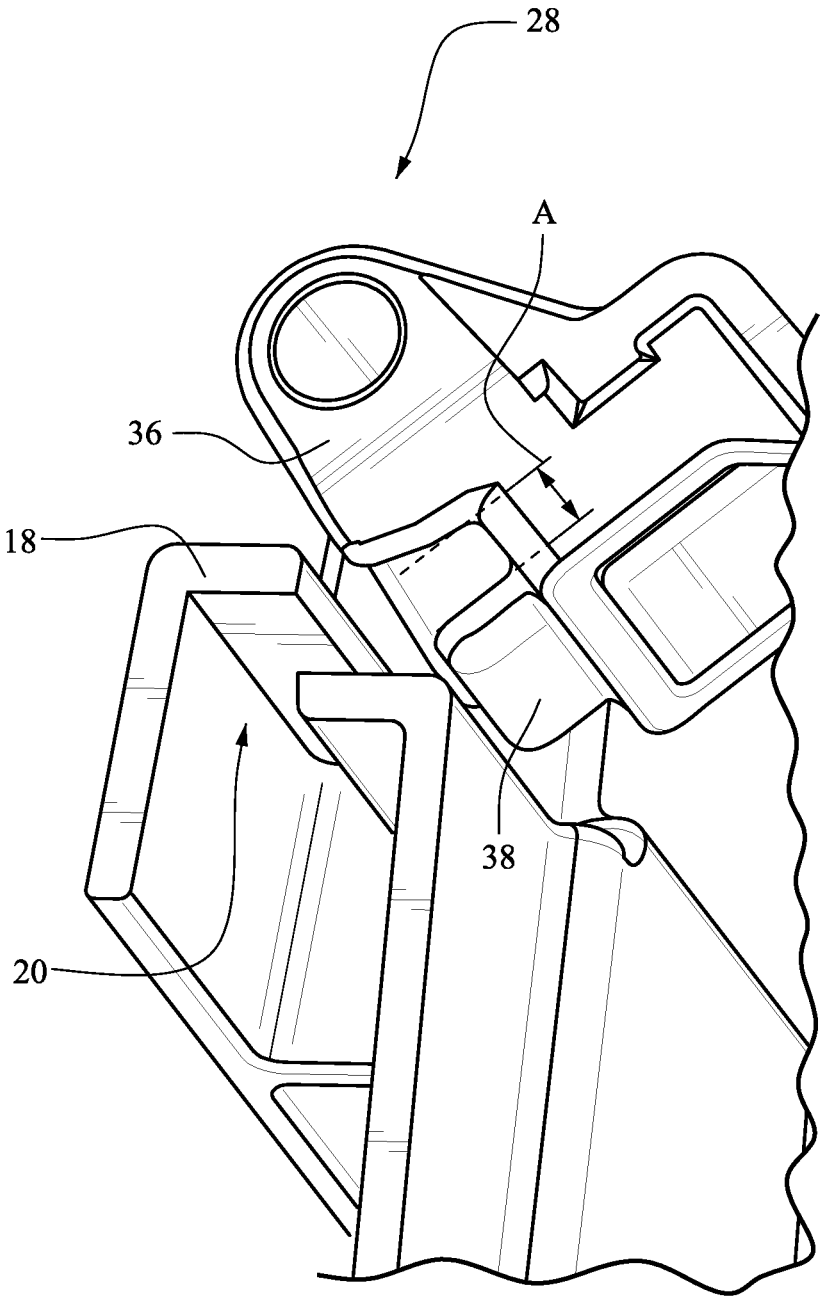
Figure 5:
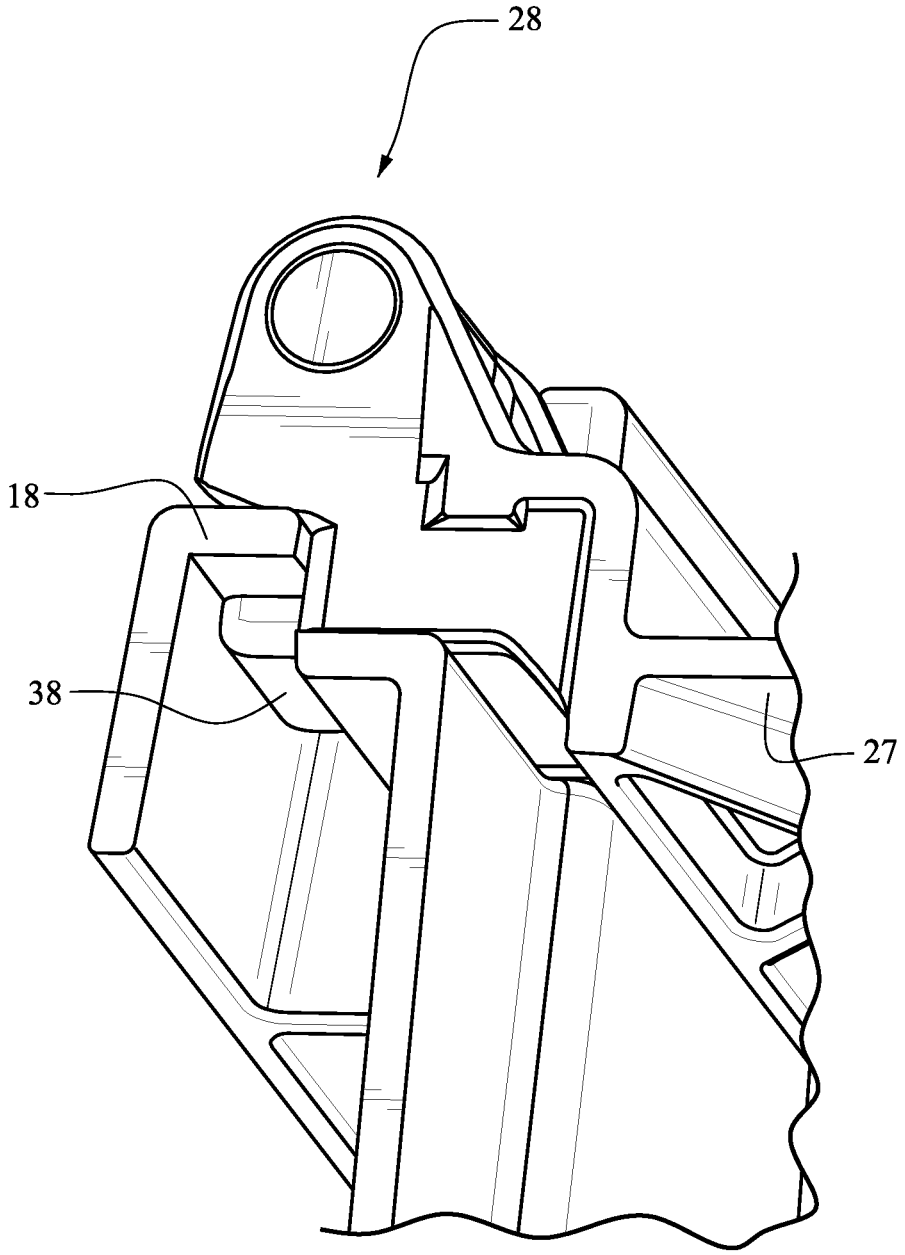

With reference to FIGS. 3-5, the lid 27 and thereby the hinge segments 28 are displaceable between an open position and a closed position. As the lid 27 is closed, the security tab 38 is extended into the undercut 20 such that the shoulder 18 is sandwiched between the security tab 38 and the segment rails 36 (and the hinge pins 32). In closed position, the security tab 38 is engaging in the undercut 20, and the shoulder 18 limits the vertical travel of the lid 27 (i.e., prevents the disengagement of the hinge pins 32). In an exemplary construction, the horizontal travel of the lid 27 is further restricted by the opposing lid which is engaged with the lid 27 when closed. Both lids may be secured with cable ties in the center of the ends 24.

The described embodiments provide a very high level of container security and tamper evidence. To access a closed container, it would require tools and a high level of force to disengage the security tabs and the hinge pins. It would not be possible to re-engage the hinge segments with the container if disengaged, thereby providing tamper evidence in the event the container was breached or a breach was attempted. The described embodiments are particularly suitable for a molded container with an all-plastic hinge (i.e., no metal hinge pins).

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A container comprising:

an enclosure including a top perimeter, the top perimeter including hinge segment openings with a shoulder defining an undercut within each of the hinge segment openings;

a container lid pivotably securable to the enclosure and displaceable between an open position and a closed position; and a plurality of hinge segments connected to the container lid, the hinge segments including hinge pins pivotably secured in the hinge segment openings and a security tab positionable under the shoulder and into the undercut, the security tab being displaceable with the container lid, and the security tab being positioned into the undercut by pivoting the container lid to the closed position, wherein the hinge pins are secured in slots defined in sides and tops of the hinge segment openings and recessed in the top perimeter.

2. The container according to claim 1, wherein the enclosure comprises two sides and two ends, wherein the sides are longer than the ends, and wherein the hinge segment openings are defined in the sides.

3. The container according to claim 2, wherein the hinge segments comprise segment rails connected to the container lid adjacent sides of the hinge segment openings and extending substantially parallel to the container ends.

4. The container according to claim 1, wherein the hinge segments are displaceable with the container lid between the open position and the closed position, and wherein in the closed position, the security tab is engaged with the undercut and the shoulder is disposed between the security tab and the hinge pins.

5. The container according to claim 1, wherein the container lid is secured to the enclosure with parts made only of plastic.

6. A container comprising:

an enclosure including a top perimeter, the top perimeter including hinge segment openings with a shoulder defining an undercut within each of the hinge segment openings;

a container lid; and a plurality of hinge segments connected to the container lid, the hinge segments including hinge pins pivotably secured in the hinge segment openings and a security tab engageable with the undercut, wherein the hinge pins are secured in slots defined in sides and tops of the hinge segment openings and recessed in the top perimeter, wherein the hinge segments comprise segment rails connected to the container lid adjacent sides of the hinge segment openings and extending substantially parallel to the container ends, wherein the hinge segments are displaceable between an open position and a closed position, and wherein the security tab is disposed spaced from the segment rails such that in the closed position, the undercut is sandwiched in the space between the security tab and the segment rails.

7. The container according to claim 6, wherein the security tab is positioned on an opposite side of the hinge segment from the container lid.

8. A hinge segment coupleable with a container lid for connecting the container lid to a container, the container including hinge segment openings with a shoulder defining an undercut, the hinge segment comprising:

hinge pins pivotably securable in the hinge segment openings;

a security tab engageable with the undercut;

a main panel oriented in a plane substantially perpendicular with the container lid; and segment rails disposed on opposite sides of the main panel, wherein the hinge pins are coupled with the segment rails and extend outward from the segment rails.

9. The hinge segment according to claim 8, wherein the security tab is substantially perpendicular to the main panel and is spaced from the segment rails along the main panel, and wherein the space between the security tab and the segment rails is sized to receive the shoulder.

10. The hinge segment according to claim 8, wherein the hinge segment is displaceable between an open position and a closed position, and wherein in the closed position, the security tab is engageable with the undercut and the shoulder is positionable between the security tab and the hinge pins.

* * * * *